US005257781A

United States Patent [19]

Sines et al.

[11] Patent Number: 5,257,781

[45] Date of Patent: Nov. 2, 1993

[54] RETAINED ROCKER STRING SPORTS RACKET

[75] Inventors: Randy D. Sines; Irene C. Sines, both of Spokane, Wash., now by change of name from Sue-Yueh Cheng

[73] Assignee: MITT USA Corporation, Spokane, Wash.

[21] Appl. No.: 5,996

[22] Filed: Jan. 19, 1993

[51] Int. Cl.[5] ..... A63B 49/00; A63B 51/12

[52] U.S. Cl. ..... 273/73 D; 273/73 R

[58] Field of Search ..... 273/73 R, 73 C, 73 D, 273/73 E, 73 G

[56] References Cited

U.S. PATENT DOCUMENTS

| | | | |
|---|---|---|---|
| 1,470,878 | 10/1923 | Robinson . | |
| 1,523,865 | 1/1925 | Craig . | |
| 1,559,986 | 11/1925 | Quick . | |
| 2,145,785 | 1/1939 | Aubert . | |
| 2,456,023 | 12/1948 | Rosenbalm . | |
| 3,884,467 | 5/1975 | Sommer . | |
| 3,999,756 | 12/1976 | Head . | |
| 4,118,029 | 10/1978 | Septier . | |
| 4,140,316 | 2/1979 | Coupar | 273/73 D |
| 4,185,822 | 1/1980 | Li . | |
| 4,203,597 | 5/1980 | Reedhead et al. . | |
| 4,441,712 | 4/1984 | Guthke . | |
| 4,462,592 | 7/1984 | Legger et al. . | |
| 4,566,695 | 1/1986 | Melby | 273/73 D |
| 4,591,165 | 5/1986 | Sines et al. . | |
| 4,595,201 | 6/1986 | Fischer . | |
| 4,664,380 | 5/1987 | Keubler . | |
| 4,681,319 | 7/1987 | Zilinskas . | |
| 4,765,621 | 8/1988 | Game | 273/73 D X |
| 4,768,786 | 9/1988 | Kuebler . | |
| 4,930,782 | 6/1990 | Sines et al. . | |
| 5,054,779 | 10/1991 | Marrello | 273/73 D |

FOREIGN PATENT DOCUMENTS

| | | |
|---|---|---|
| 873589 | 7/1942 | France . |
| 4305 | of 1914 | United Kingdom . |
| 262638 | 12/1926 | United Kingdom . |
| 309238 | 4/1929 | United Kingdom . |

*Primary Examiner*—V. Millin
*Assistant Examiner*—Raleigh W. Chiu
*Attorney, Agent, or Firm*—Wells, St. John, Roberts, Gregory & Matkin

[57] ABSTRACT

A sports racket includes a handle and a racket head frame. String holes are formed through the head frame into a string opening defined within the head frame. Rocker assemblies are mounted upon the head frame and a racket string trained over them. Each rocker assembly includes a rocker mount and a rocker member. The rocker mount has an outwardly facing rocker support surface. The rocker member has a rocking surface which rests against the rocker support surface. The rocker member is durably attached to the rocker mount. The rocker member transfers string tension between adjacent chords of a racket string.

29 Claims, 6 Drawing Sheets

RETAINED ROCKER STRING SPORTS RACKET

TECHNICAL FIELD

The present invention relates to transmitting string tension between adjacent chords of a strung sports racket upon impact with a ball or other playing object.

BACKGROUND OF THE INVENTION

Conventional sports rackets have strings which are effectively anchored as they pass through string holes, formed through the head frame of the racket. This effectively divides the string into individual string chords which span the head frame. The effective isolation of each string chord causes localized high dynamic string tension in each chord as it contacts a ball. Static and dynamic string tension are known to affect various performance factors of a sports racket, including power and control.

Devices for transmitting or equalizing string tension between adjacent sports racket string chords were shown and described in U.S. Pat. Nos. 4,930,782 and 4,591,165. The rocker devices described in those patents served to increase the effective length of string chords and to thereby reduce the peak tension in the racket strings while hitting a ball. This resulted in increased power, lower vibration and stress in the racket frame, and more balanced restoring forces. These constructions also provided a more uniform rebound response for impacts occurring over the various areas of the string hitting surface.

To achieve these results, individual string rockers were placed between adjacent string holes in the racket head frame. Each rocker was comprised of an elongated member having a length approximately equal to the distance between two adjacent string holes. The upper surface of each rocker had a groove for receiving a string.

During assembly, a string was threaded outward through a first string hole, over the rocker, and then inward through a second, adjacent string hole. The string thus was trained over the rocker. When tensioned, the adjacent string chords applied inward force to the rocker which retained the rocker. The string forces were transferred through the rocker and against the racket frame. The curved bottom surface of the rocker caused rocking to occur when the string chords experienced different tensile forces. This allowed tension from one string chord to be transmitted to the adjacent string chord. The string holes were large enough to allow unimpeded passage of individual strings, so as not to anchor strings as they passed through the string holes.

The rocker devices described above provided an important and dramatic performance improvement over previously known sports rackets. However, assembly and use of these rackets was not without problems. For instance, it was difficult to retain individual rockers in place during stringing. A broken string could result in some or all of the rockers being lost from the racket, and possibly scattered over a playing court. Restringing involved the same problems as original assembly, while also requiring the need for the user or repairer to stock spare rockers to replace those lost after a string break.

The invention described below provides an effective solution to the noted deficiencies in previous rocker-equipped rackets. The invention also provides a number of other advantages and features which are explained or can be appreciated from the description given herein.

BRIEF DESCRIPTION OF THE DRAWINGS

Preferred embodiments of the invention are described below with reference to the accompanying drawings. The drawing figures are briefly described below.

DETAILED DESCRIPTION OF THE PREFERRED EMBODIMENT

This disclosure of the invention is submitted in furtherance of the constitutional purposes of the U.S. Patent Laws "to promote the progress of science and useful arts." U.S. Constitution, Article 1, Section 8.

Figure 1:
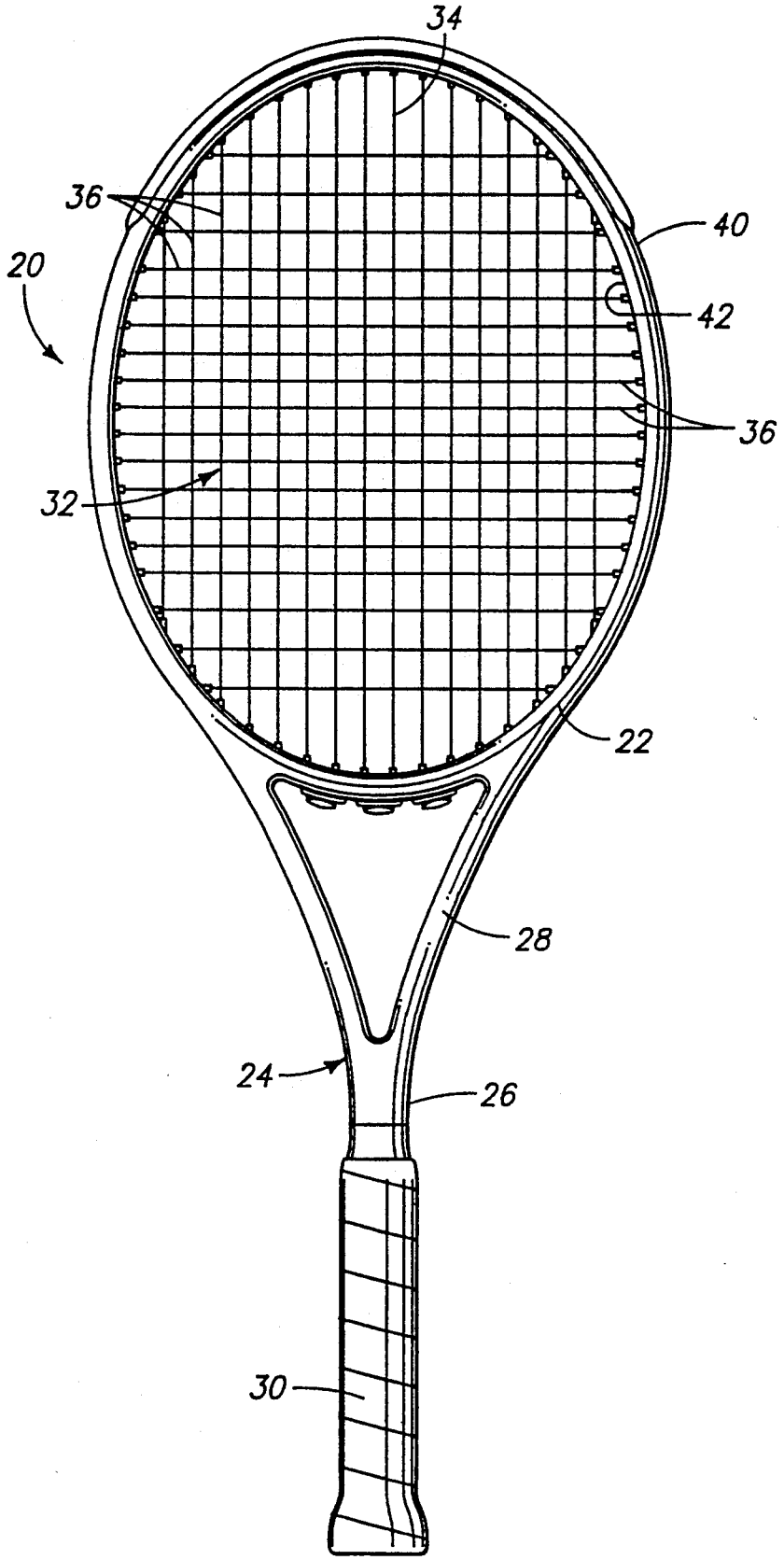
FIG. 1 is a front view of a sports rackets in accordance with a preferred embodiment of the invention.
Figure 2:
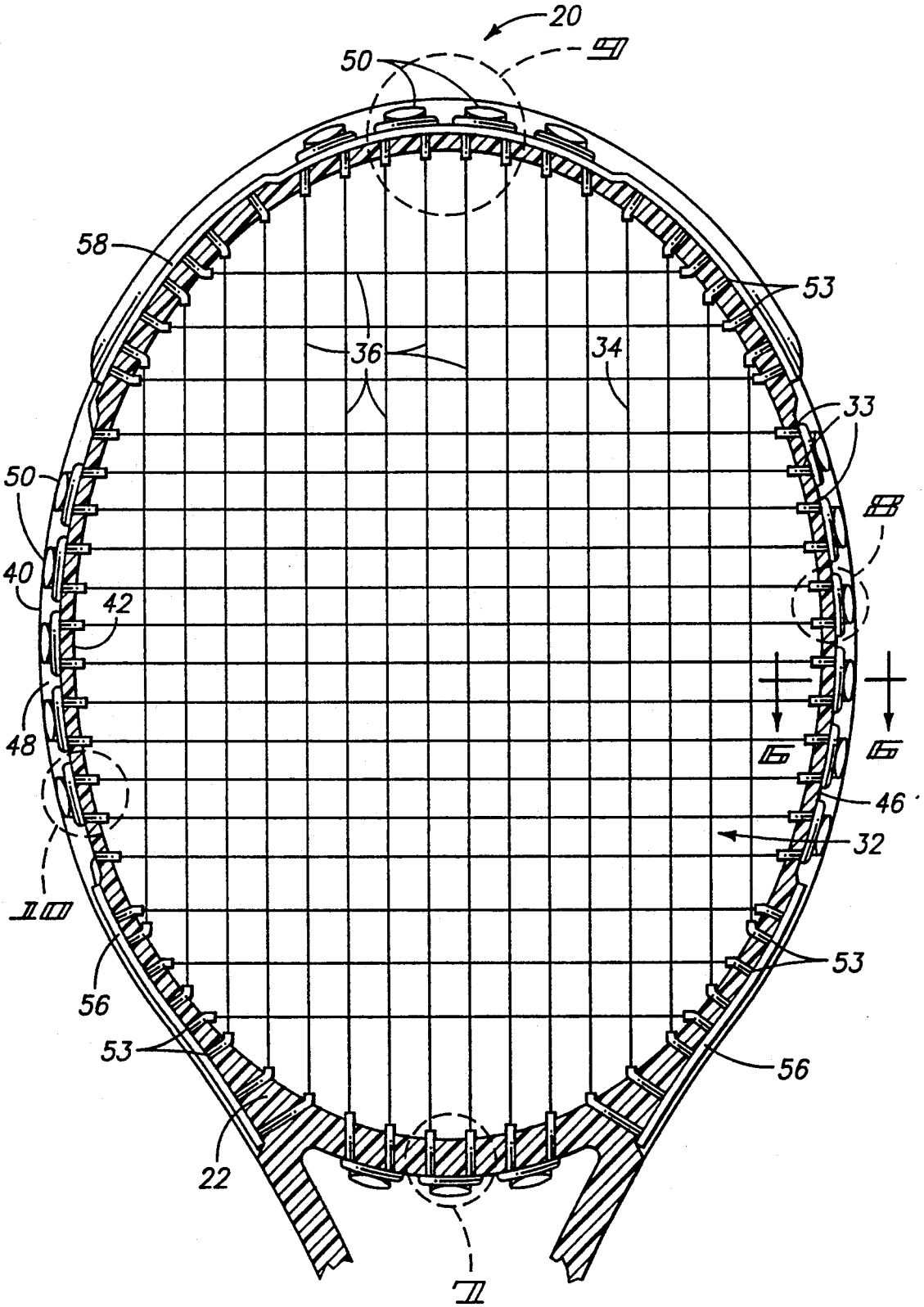
FIG. 2 is an enlarged sectional view showing a portion of the sports racket shown in FIG. 1.

FIG. 1 shows a preferred form of sports racket built in accordance with the invention. The racket is generally designated by the reference numeral 20. Sports racket 20 includes a racket head frame 22 connected to an elongated handle 24. Handle 24 includes a shaft 26 which is connected by a throat 28 to racket head frame 22. Handle 24 also includes a handgrip 30. The exemplary configuration is that of a mid-sized tennis racket, which may be made from graphite fiber impregnated resin. However, the present invention can also be incorporated into any size of sports racket made from any suitable material, including rackets having a variety of shapes, sizes and configurations.

Head frame 22 is aligned in a substantially planar relationship with handle 24. Head frame 22 is formed about and defines a string opening 32 within the interior of the head frame. A plurality of string holes 33 are formed through the head frame into the string opening. A string or strings 34 are threaded through frame 22 in any desired woven or crisscross fashion forming individual string chords 36 which extend from one point to another point on the head frame. Conventional sports racket strings made from a single strand of gut or synthetic string material are appropriately used with the invention. The ends of the strings can be secured to the head frame in any suitable manner. The woven string pattern defines substantially planar racket faces for impact with a ball or other playing object.

The head frame of racket 20 includes a curved outer perimeter defined by outer head frame surfaces 40. The outer head frame surfaces are oriented outwardly away from the string opening 32. An inner head frame surface 42 defines the shape of string opening 32. String holes 33 preferably extend outwardly from inner surface 42 through the head frame to the outer surface 40.

Frame 22 is also preferably provided with one or more head frame channels 44 (refer to FIG. 6) which extend about the outer periphery of the head frame. As shown, channel 44 is substantially annular about the head frame except at the yoke or throat 28. The base or bottom surface of channel 44 forms an outwardly facing head frame support surface 46. Support surface 46 is situated between channel walls 48.

Racket 20 also preferably includes tension transmitting rocker assemblies 50 which support the string chords in relation to the frame so as to allow rocking action. The rocking action allows transfer of tension between string chords and thus provides improved elastic and playing performance characteristics. Tension transmitting assemblies 50 are mounted upon head frame 22 at selected string holes to support racket string 34. More specifically, individual rocker assemblies 50 are advantageously positioned on support surface 46 over or between adjacent pairs of string holes to extend between said pairs of string holes. String 34 is received or looped over individual rocker assemblies and through the corresponding string holes to form adjacent chords 36 within string opening 32.

Rocker assemblies 50 function to transmit string tension between adjacent chords of the sports racket. It is not necessary to utilize rocker assemblies in conjunction with every string chord. Rather, providing rocker assemblies for string chords spanning the central portions of the string opening has been found to be an adequate compromise between cost and performance. Accordingly, racket 20 includes string holes for which rocker assemblies are not provided. String holes not having rocker assemblies most appropriately correspond to string chords spanning side or peripheral portions of string opening 32. Such string holes are advantageously equipped with a pair of lower string guide units 56 and an upper string guide unit 58. Guide units 56 and 58 are integrally molded pieces having a plurality of inwardly extending string sleeves 53 which are spaced and angled to extend through corresponding string holes. Each string sleeve 53 has an outer diameter approximately complementary to that of its corresponding string hole and an inner diameter which is slightly larger than the string outside diameter. The racket string is threaded through the string sleeves during assembly and stringing of the racket.

The lower string guide units 56 include string guides corresponding to the five outermost longitudinally-extending string chords and to the three lowermost transversely-extending string chords. The upper string guide unit 58 extends transversely across the outer end of racket head frame 22, including string guides corresponding to the five outermost longitudinally-extending string chords on either transverse side of string opening 32. It also includes string guides corresponding to the three uppermost transversely-extending string chords. Rocker assemblies 50 are positioned over remaining string holes.

Figure 3:
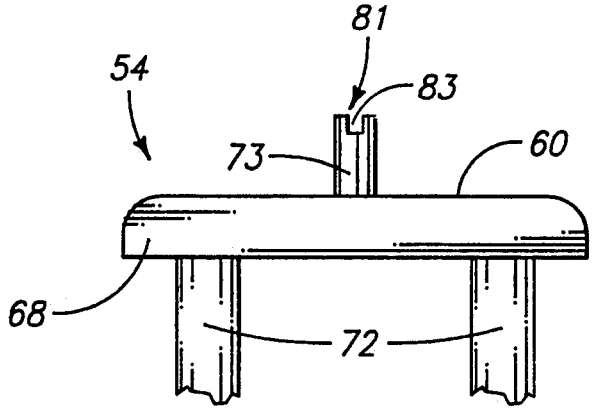
FIG. 3 is an enlarged front view of a rocker mount as used in the preferred embodiment shown in FIG. 1.
Figure 4:
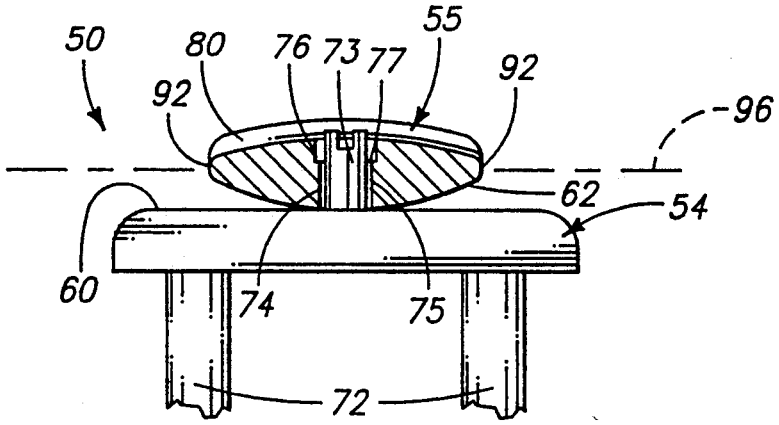
FIG. 4 is an enlarged front view of the rocker mount of FIG. 3 with a rocker member added. These components are shown in the process of being assembled together. The rocker member is shown in cross-section for purposes of illustration.
Figure 5:
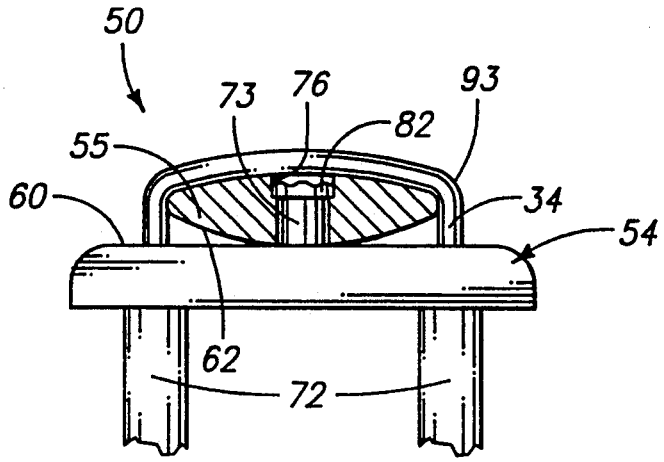
FIG. 5 is a view similar to FIGS. 3 and 4 showing the rocker mount and rocker member in a finished state of assembly. The rocker member again is shown in cross-section.

FIGS. 3–5 show the preferred construction of a single rocker assembly 50. The assembly is shown in its assembled state in FIG. 5. Rocker assembly 50 includes a rocker mount 54 and a rocker member 55. Rocker mount 54 is suitable for mounting upon head frame 22 to securely position rocker assembly 50 relative to the head frame. Rocker member 55 is durably mounted or attached to rocker mount 54 in such a way that the rocker member is retained thereto yet the rocker member is capable of rocking action relative to the rocker mount. This rocking action transfers string tension between adjacent chords of a racket string which is supported on or over the rocker assembly.

The rocking action of rocker member 55 is provided by appropriately shaped reaction or contact surfaces on rocker mount 54 and rocker member 55. Rocker mount 54 has an outwardly facing contact surface 60 which, as shown, is essentially planar. Rocker member 55 has an elongated body with an inwardly facing, curved contact or rocking surface 62. Rocker member 55 is positioned between the string and rocker mount 54 so that the reactive contact forces between surfaces 60 and 62 carry the combined load imposed by the string chords connected at each end of the rocker member. Since the string is not anchored in its string holes, string tension in either chord is transmitted to the adjacent chord by rocking motion of rocker member 55 relative to the rocker mount 54 and racket frame.

Figure 6:
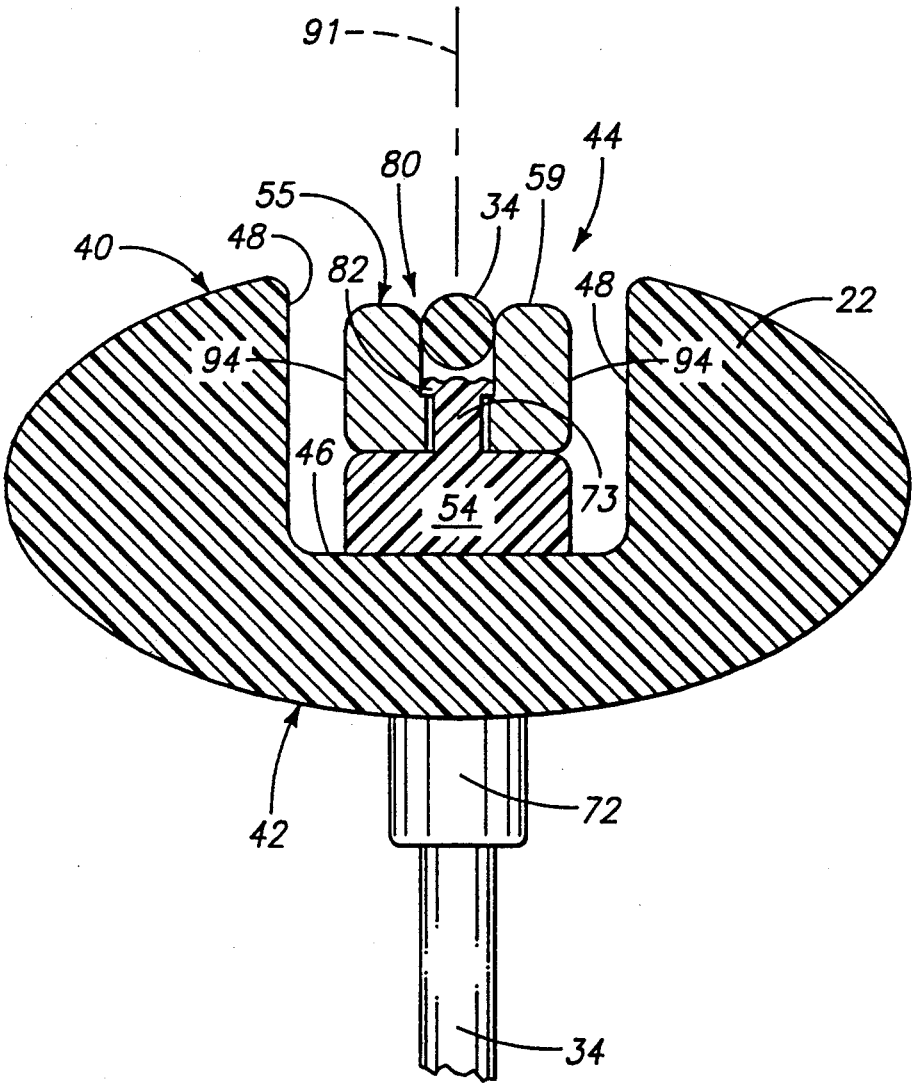
FIG. 6 is an enlarged cross-sectional view of a rocker mount and rocker member taken along line 6—6 of FIG. 2.
Figure 7:
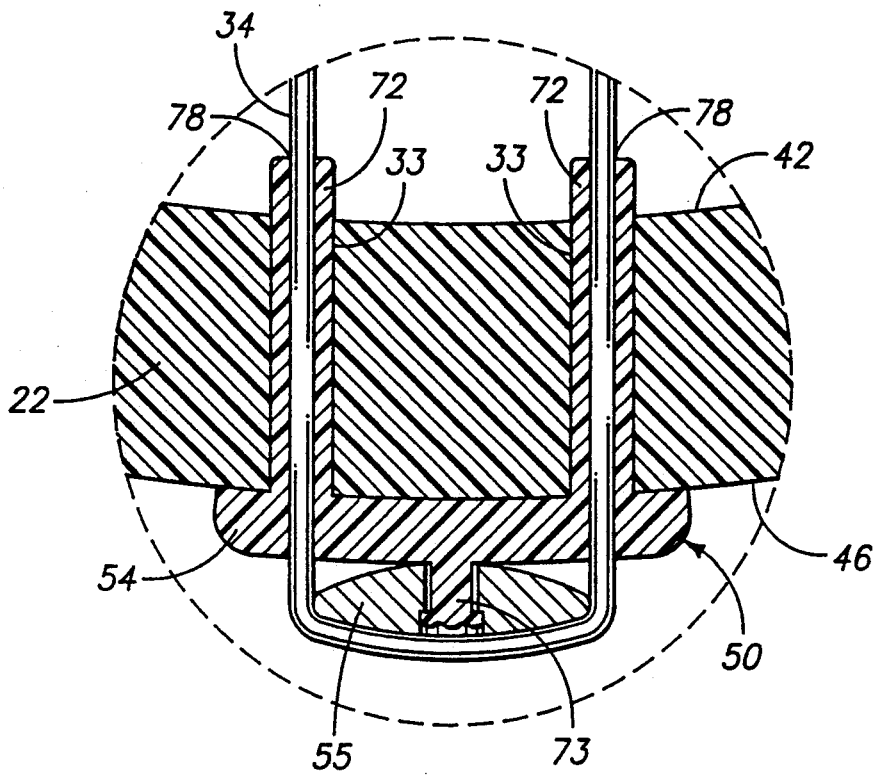
FIG. 7 is a detailed sectional view of a lower rocker assembly as expanded from circle 7 of FIG. 2.
Figure 8:
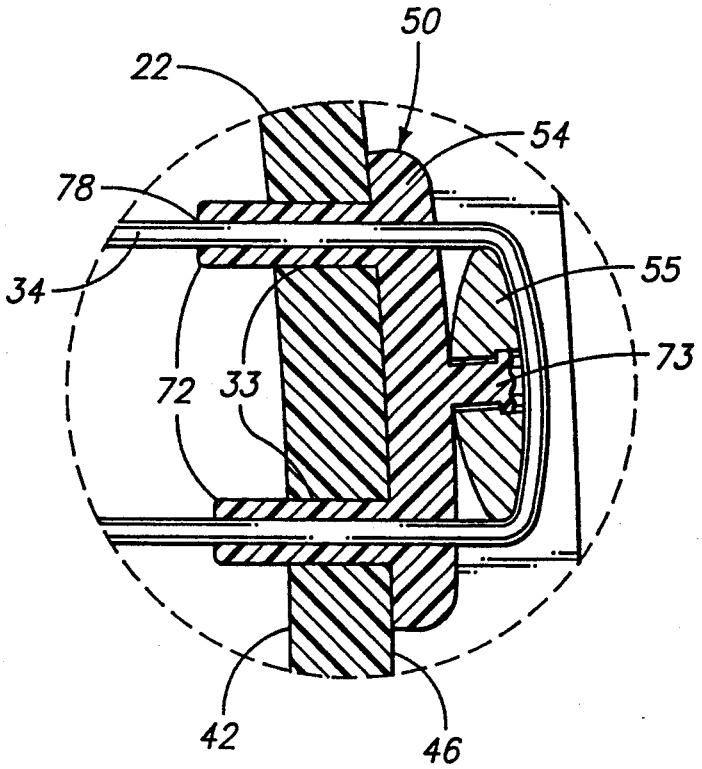
FIG. 8 is a detailed sectional view of a first side rocker assembly as expanded from circle 8 of FIG. 2.
Figure 9:
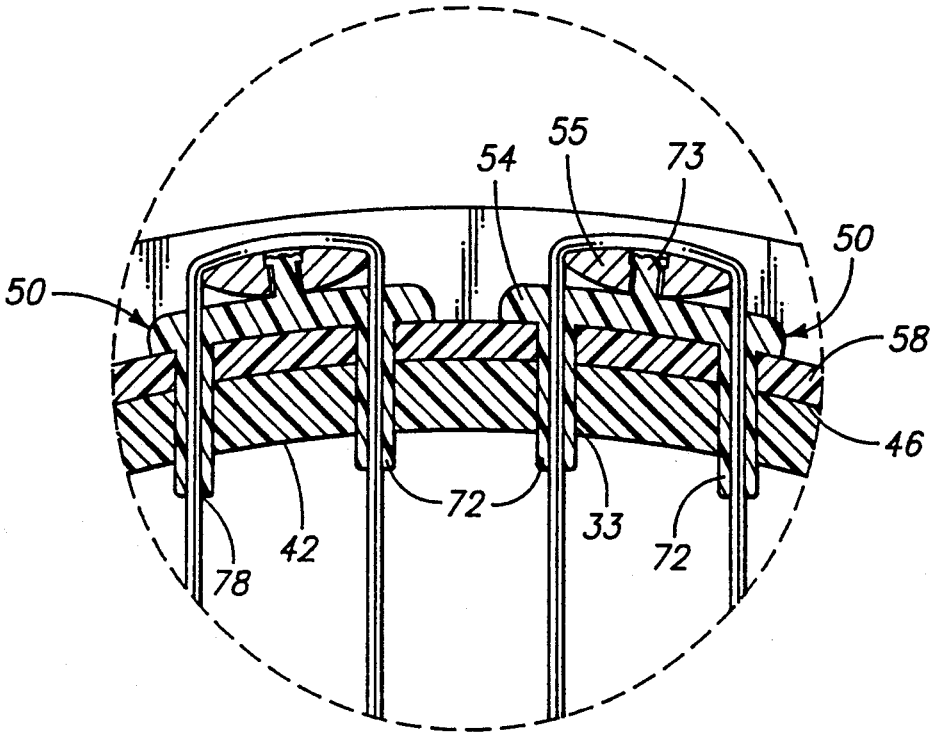
FIG. 9 is a detailed sectional view of upper rocker assemblies as expanded from circle 9 of FIG. 2.
Figure 10:
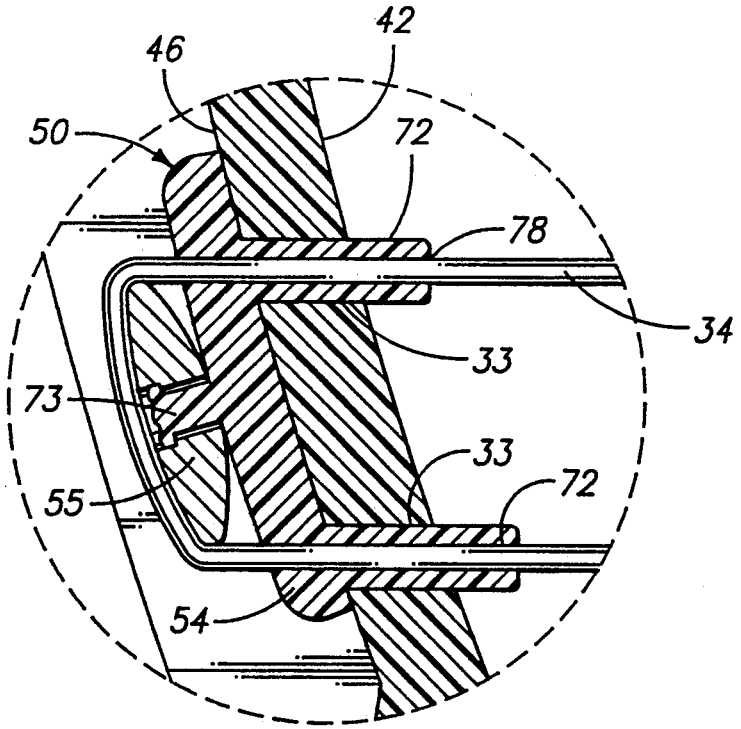
FIG. 10 is a detailed sectional view of a second side rocker assembly as expanded from circle 10 of FIG. 2.

The tension transferring rocker member 55 is preferably constructed as an elongated member having a substantially rigid form which can support the forces applied by the associated string chords 36. The rocker must be sufficiently rigid so that no significant elastic or plastic deformation occurs due to impact with the string surface. The elongated rocker member has a longitudinal medial plane 91 which extends as shown in FIG. 6 to substantially bisect the rocker member into two elongate halves. Rocker member 55 also has two opposing distal rocker ends 92 (FIG. 3). Distal ends 92 are preferably convexly curved to reduce bending stresses in string bends 93 experienced by string 34 as the string is trained over the distal ends (see FIG. 5). A longitudinal axis 96 lies in medial plane 91 extending between the distal ends. The longitudinal axis is approximately parallel to the contact surface 60 when the rocker is in a neutral position.

Rocker member 55 also has a curved bottom or rocking surface 62 which extends between distal ends 92 adjacent to the support surface 60 of mount 54. As shown, rocking surface 62 is convex and engages with the planar support surface 60 along a contact line. The contact line developed between surfaces 60 and 62 moves from a central position toward the distal ends in response to increasing force applied through an associated string chord. This movement minutely reduces the distance from the fulcrum established at the contact line out to the distal end which is experiencing increased force. This responsive movement of the rocker member conversely minutely increases the distance between the contact line and the opposite distal end which supports the string chord which is receiving increased tension by transfer through the tension transfer assembly 50.

Rocker member 55 has side surfaces 94 (FIG. 6) which extend between the opposing distal ends and the upper surface 59 and lower or bottom surface 62. The side surfaces are roughly parallel to each other and parallel to medial plane 91.

Rocker member 55 includes a string groove 80 which runs longitudinally along upper surface 59 for receiving and guiding a string which is looped thereover. String groove 80 preferably lies in medial plane 91 and has a width which is approximately equal to or slightly larger than the width of the racket string. Groove 80 is slightly convex along the longitudinal axis of rocker member 55 and generally concave with a transverse plane of member 55 to conform to the shape of a received string. Rocker member 55 has a longitudinal length approximately equal to the distance between two adjacent string holes, minus the diameter of the racket string. Rocker member 55 can alternatively be constructed without string groove 80.

Rocker member 55 is preferably formed from aluminum or other material providing good rigidity in the medial plane, with durability and good contact strength.

FIG. 3 shows a preferred rocker mount 54 before it is assembled with rocker member 55. Mount 54 includes an elongated base member 68 which forms the outwardly facing contact surface 60. As shown, the outwardly facing mount contact surface 60 is substantially planar. Rocker mount 54 is positioned and mounted between rocker member 55 and head frame 22 to retain, position and support the rocker member 55 relative to the frame. The mount is preferably positioned to support the rocker member between a pair of adjacent string holes. Rocker mount 54 has a frame engagement feature which positions and holds the rocker mount 54 relative to the frame. Preferably, the mounting or frame engagement feature includes at least one engagement or mounting extension which mates with a corresponding engagement or mounting receptacle in the frame. In the preferred embodiment, the engagement extension is advantageously formed by one or more integrally formed string guides 72 which fit within one or more string holes 33. As shown, rocker mount 54 includes a pair of such integrally formed string guides 72 which extend inwardly from base member 68 and which are received in an adjacent pair of string holes 33. This construction effectively positions and holds the rocker assembly relative to the frame. The sizes and degree of mechanical fit or interference between the extensions 72 and holes 33 allow a good hold yet removal for replacement. After stringing, the rocker assembly is securely held. In the preferred embodiment, each string guide 72 has an outer diameter which is approximately equal to the diameter of the corresponding string hole. The inside diameter of the string channel 78 is preferably slightly larger than the outer diameter of the racket string 34.

Rocker mount 54 also has a rocker connection mechanism or feature which connects between rocker mount 54 and rocker member 55 to durably attach and retain rocker member 55 to rocker mount 54. As shown, the rocker connection mechanism includes a rocker connection feature on mount 54 which is preferably an upstanding element that extends outwardly from base member 68 to engage with rocker member 55. The rocker connection element in the preferred embodiment is a stud, post or pin 73 which extends into and at least partially through an aperture 74 formed in rocker member 55. Stud 73 is most preferably integrally formed with the base 68 of the mount 54, such as by molding therewith. Stud 73 is also preferably formed to include a deformable head 81 which is capable of being upset or otherwise deformed to provide an enlarged stud head 82. Mount 54 is most preferably injection molded from a suitable material, such as a synthetic polymer plastic, into the desired shape and size.

Rocker member 55 has a mounting aperture 74 which extends into and preferably through rocker member 55 from curved contact surface 62 for engagement with mounting element 73. The aperture has a first or inward bore 75. The mounting aperture also preferably has a second or outer bore or counterbore in the form of an enlarged bore portion 76 at its outer end. A shoulder is formed at the transition between the smaller first bore 75 and the counterbore 76. The shoulder serves to engage with an enlarged head 82 on the stud 73 or other rocker connection feature. Counterbore 76 is advantageously formed beneath the bottom of string groove 80. Stud 73 extends upward through aperture 74. The enlarged head has a peripheral portion which bears upon shoulder 77 to mechanically restrain the rocker member to the mount 54.

Enlarged head 82 is preferably heated and deformed to provide the upset configuration shown in FIG. 5 enlarged within counterbore 76. The enlarged head retains rocker member 55 over rivet 73 and also retains curved surface 62 against adjacent planar surface 60. The stud and head are sufficiently flexible to allow rocking of rocker member 55.

FIGS. 7–10 show variations in form of rocker assembly 50 as used in different positions around the perimeter of frame 22. The primary difference between variations is the length and angle of string guides 72. These dimensions and angles are varied so that the rocker assemblies fit within and extend completely through their corresponding string holes 33. The rocker member is considered to be in a neutral position when the associated string chords are balanced and not subject to any external forces, such as from a contacting ball. In the neutral position, the longitudinal axis of rocker member 55 is approximately parallel to string support surface 46. In some positions around the racket head frame the string holes are not perpendicular to string support surface 46. Accordingly, the nominal position of the rockers is not always perpendicular to the strings which loop over the rockers. Furthermore, rocker assemblies positioned at the top of racket 20, shown in FIG. 9, must have string guides of sufficient length to pass through string guide unit 58, which lies beneath such rocker assemblies. Appropriate apertures are formed in string guide unit 58 to correspond to the underlying string holes.

The racket frame is constructed and fabricated in accordance with conventional methods and materials to achieve the desired shape, size, and configuration in accordance with the description above. The frame is preferably formed from a graphite fiber impregnated resin.

Tension transmitting assemblies 50 are preferably fabricated as two parts which are subsequently assembled and fastened together by heating and upsetting head 81 of stud 73. One of these parts, rocker member 55, is preferably formed by casting aluminum in the desired shape and size. Rocker mount 54 is preferably injection molded from a polymer in the desired shape and size.

Assembly of racket 20 is accomplished by first placing lower string guide units 56 and upper string guide unit 58 as indicated above. Individual rocker assemblies 50 are then inserted in appropriate pairs of string holes. The racket is subsequently stringed in a conventional manner, with a racket strings being looped through and over individual rocker assemblies.

Use of the racket is identical with the use of a conventional racket, except that the rocker assemblies improve racket performance characteristics in a manner somewhat similar to an "oversized" racket. The rocker assemblies accomplish this performance improvement by transmitting tension between adjacent string cords, thus increasing the effective length of each string chord.

Because the described rocker assemblies are mounted to a racket prior to stringing, the complexity of the stringing operation is greatly reduced in comparison to rackets employing previous tension transmitting devices. The mounting also serves to automatically and accurately align the rocker members to string holes. Furthermore, rocker members are retained relative to the racket frame even in the absence of a string, such as when a string breaks. Subsequent restringing is simplified because rocker members remain in their proper positions.

The assembly also provides integral string guides which more accurately position the string chords while still allowing free longitudinal movement of the string within the guides. Furthermore, the surface which supports the rocker member is integral to the rocker assembly, rather than being formed by the racket frame itself. This not only allows convenient replacement of the support surface during restringing, but also allows the characteristics of the support surface to be more easily controlled. Enhanced performance of the rocker member is the result of the unique assembly. This performance is obtained without adding significantly to material costs, while actually reducing assembly costs.

In compliance with the statute, the invention has been described in language more or less specific as to structural features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A sports racket comprising:

a handle;

a racket head frame connected to the handle, the head frame being formed about a string opening;

a plurality of string holes formed in the head frame toward the string opening;

a tension transmitting assembly mounted upon the head frame for supporting a racket string thereon; said tension transmitting assembly including a mount and a rocker member which is durably attached to the mount; and said rocker member being capable of rocking action relative to the mount to transfer string tension between adjacent chords of a racket string which is supported thereon.

2. The sports racket of claim 1 wherein the mount includes a mounting feature which positions the tension transmitting assembly relative to the frame.

3. The sports racket of claim 1 wherein the mount includes at least one mounting extension which mates with a mounting receptacle in the frame to position the tension transmitting assembly relative to the frame.

4. The sports racket of claim 1 wherein the mount includes a pair of string guides which mate with an adjacent pair of string holes to position the tension transmitting assembly relative to the frame.

5. The sports racket of claim 1 further comprising a connection element which connects between the mount and the rocker member to durably attach the rocker member to the mount.

6. The sports racket of claim 1 wherein the mount includes a stud which extends at least partially through the rocker member to durably attach the rocker member to the mount.

7. The sports racket of claim 1 wherein:

the rocker member has a mounting aperture with a counterbore at its outer end; and the mount includes a stud which extends through the rocker member mounting aperture and into the counterbore, the stud having an enlarged end within the counterbore to retain the rocker member.

8. The sports racket of claim 1 wherein the mount has an outwardly facing rocker support surface, and the rocker member has a curved rocking surface which rests against the rocker support surface.

9. The sports racket of claim 1 and further comprising:

a connection element which connects between the mount and the rocker member to durably attach the rocker member to the mount;

wherein the mount has an outwardly facing rocker support surface, the rocker member having a curved rocking surface which rests against the rocker support surface; and wherein the mount includes at least one mounting extension which mates with a mounting receptacle in the frame to position the tension transmitting assembly relative to the frame.

10. A sports racket comprising:

a handle;

a racket head frame connected to the handle, the head frame being formed about a string opening;

a plurality of string holes formed through the head frame into the string opening;

a rocker member;

a mount which connects between the frame and the rocker member to position the rocker member relative to the frame between a pair of string holes; and said rocker member supporting a racket string which is strung over the rocker member and through said pair of string holes, said rocker member being capable of rocking action to transfer string tension between string chords.

11. The sports racket of claim 10 wherein the mount includes at least one mounting extension which mates with a mounting receptacle in the frame to position the mount relative to the frame.

12. The sports racket of claim 10 wherein the mount includes a pair of string guides which mate with an adjacent pair of string holes to position the mount relative to the frame.

13. The sports racket of claim 10 further comprising a rocker connection element which connects between the mount and the rocker member to durably attach the rocker member to the mount.

14. The sports racket of claim 10 wherein the mount includes a stud which extends at least partially through the rocker member to durably attach the rocker member to the mount.

15. The sports racket of claim 10 wherein:

the rocker member has a mounting aperture with a counterbore at its outer end;

the mount includes a stud which extends through the rocker member mounting aperture and into the counterbore, the stud having an enlarged end within the counterbore to retain the rocker member.

16. The sports racket of claim 10 wherein the mount has an outwardly facing rocker support surface, the rocker member having a curved rocking surface which rests against the rocker support surface.

17. A tension transmitting assembly for supporting a racket string relative to a sports racket, the sports racket having a head frame formed about a string opening, the head frame having a plurality of string holes formed therein toward the string opening, the tension transmitting assembly comprising:

a rocker member which is formed to receive a racket string;

a mount which is durably attached to the rocker member, the mount being mountable to the frame to position the tension transmitting assembly relative to the frame; and the rocker member being capable of rocking action relative to the mount to transfer string tension between adjacent chords of a racket string which is received thereon.

18. The tension transmitting assembly of claim 17 wherein the mount includes at least one mounting extension which mates with a mounting receptacle in the frame to position the tension transmitting assembly relative to the frame.

19. The tension transmitting assembly of claim 17 wherein the mount includes a pair of string guides which mate with an adjacent pair of string holes to position the tension transmitting assembly relative to the frame.

20. The tension transmitting assembly of claim 17 further comprising a rocker connection element which connects between the mount and the rocker member to durably attach the rocker member to the mount.

21. The tension transmitting assembly of claim 17 wherein the mount includes a stud which extends at least partially through the rocker member to durably attach the rocker member to the mount.

22. The tension transmitting assembly of claim 17 wherein:

the rocker member has a mounting aperture with a counterbore at its outer end;

the mount includes a stud which extends through the rocker member mounting aperture and into the counterbore, the stud having an enlarged end within the counterbore to retain the rocker member.

23. The tension transmitting assembly of claim 17 wherein the mount has an outwardly facing rocker support surface, the rocker member having a curved rocking surface which rests against the rocker support surface.

24. The sports racket of claim 17 and further comprising:

a rocker connection element which connects between the mount and the rocker member to durably attach the rocker member to the mount;

wherein the mount has an outwardly facing rocker support surface, and the rocker member has a curved rocking surface which rests against the rocker support surface; and wherein the mount includes at least one mounting extension which mates with a mounting receptacle in the frame to position the tension transmitting assembly relative to the frame.

25. A rocker mount for mounting a rocker member on a sports racket wherein the rocker member supports a racket string relative to the sports racket, the sports racket having a head frame with a plurality of string holes, the rocker mount comprising:

a base member; said base member having an outwardly facing rocker support surface against which a rocker rests;

a mounting feature connected to the base member for engaging with frame to position the base member relative to the frame;

a rocker connection which extends outwardly from the base member to engage a rocker member.

26. The rocker mount of claim 25 wherein the rocker connection comprises an outwardly extending stud which extends at least partially through the rocker member to durably attach the rocker member to the rocker mount.

27. The rocker mount of claim 25 wherein the rocker connection comprises a stud which extends through an aperture in the rocker member, the stud having an enlarged end to retain the rocker member over the stud.

28. A rocker for supporting a racket string relative to a sports racket, the sports racket having a head frame formed about a string opening, the head frame having a plurality of string holes formed into the string opening, the rocker comprising:

an elongated member having a curved rocking surface, the elongated member being formed to support a racket string which is strung over the elongated member and through an adjacent pair of string holes, said rocker member being capable of rocking action relative to the frame to transfer string tension between string chords associated with said pair of string holes; and a mounting aperture extending at least partially through the elongated member from the curved rocking surface for engagement with a rocker connection to retain the rocker to a mount.

29. The rocker of claim 28 wherein the mounting aperture has an enlarged portion for receiving an enlarged head of a rocker connection stud.

* * * * *